US008800443B1

(12) United States Patent
Demange et al.

(10) Patent No.: US 8,800,443 B1
(45) Date of Patent: Aug. 12, 2014

(54) MACHINE AND METHOD FOR MARKING ARTICLES

(71) Applicant: Illinios Tool Works Inc., Glenview, IL (US)

(72) Inventors: Florent Demange, Montreal la Cluse (FR); Vincent Tarnowski, Oyonnax (FR)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/840,537

(22) Filed: Mar. 15, 2013

(51) Int. Cl.
*B41F 13/00* (2006.01)
*B21D 22/02* (2006.01)

(52) U.S. Cl.
CPC ..... *B21D 22/022* (2013.01)
USPC ..... 101/212; 101/407.1

(58) Field of Classification Search
CPC ..... B41F 15/0877
USPC ..... 101/407.1, 212
See application file for complete search history.

(56) References Cited

U.S. PATENT DOCUMENTS 5,227,005 A * 7/1993 Zodrow et al. ..... 156/566
5,415,268 A * 5/1995 Lofgren ..... 198/394
5,651,308 A * 7/1997 Rohwetter et al. ..... 101/40.1
5,904,804 A * 5/1999 Kouda et al. ..... 156/540
5,921,175 A * 7/1999 Bates ..... 101/32
7,823,505 B2 * 11/2010 Paita ..... 101/38.1
7,845,273 B2 * 12/2010 Dumenil et al. ..... 101/44
7,866,904 B2 * 1/2011 Bungert et al. ..... 400/134
8,322,279 B2 * 12/2012 Demange et al. ..... 101/38.1
2008/0216678 A1 * 9/2008 Stockli ..... 101/25

FOREIGN PATENT DOCUMENTS

EP 2236296 10/2010

OTHER PUBLICATIONS

ISR/WO for PCT/US2014/014211 dated May 15, 2014 (10 pgs.).

* cited by examiner

*Primary Examiner* — Anthony Nguyen
(74) *Attorney, Agent, or Firm* — Christopher R. Carroll; The Small Patent Law Group LLC

(57) ABSTRACT

The present invention relates to a machine for marking articles that includes a marking head applying a marking force on an article along to a first axis; a positioning system positioning the article facing the marking head and generally along a perpendicular second axis; and a support system supporting the article during marking by the marking head. The positioning system comprises at least one carriage-turret for supporting the article. When the article is positioned facing the marking head by the at least one carriage-turret, this carriage-turret has a degree of freedom along a direction parallel to the first axis. The support system and/or the at least one carriage-turret includes backlash means along a direction parallel to a perpendicular third axis, to compensate for the shape defects of the article during application of the marking force.

10 Claims, 6 Drawing Sheets

MACHINE AND METHOD FOR MARKING ARTICLES

CROSS-REFERENCE TO RELATED APPLICATIONS

This application claims priority to French Patent Application 1350937, filed 4 Feb. 2013, and titled "MACHINE ET PROCEDE DE MARQUAGE D'ARTICLES," the entire disclosure of which is incorporated by reference.

TECHNICAL FIELD

The present invention relates to a machine and a method for marking articles, in particular by hot stamp marking. The field of the invention is that of marking rigid articles such as containers, for example made of glass, metal or plastic, with thick walls.

BACKGROUND

In a known manner, a marking machine includes a marking head fitted with at least one marking member, of the roller or punch type. The marking head is configured to apply a marking force on an article, in particular a container, by means of the marking member. The interposition of a marking tape between the marking head and the container makes it possible to create a pattern on the outer surface of the container, or indeed the interposition of a label enables the marking of the surface by labeling.

The machine may comprise one or more container transport stations facing the marking head, movable according to a linear displacement path, for example on rails, or according to a rotary displacement path, for example on a swivel castor wheel with plate. Each transport station includes one or two carriage turrets for supporting the container at its longitudinal ends. For example, the first carriage turret comprises a tailstock which is lodged in the neck of the container, while the second carriage turret comprises a catch bottom for holding the container opposite to the neck. The tailstock and the base, which are fixed in relation to one another, constitute the support means for supporting the ends of the container during its transport and marking. Such support means are satisfactory for carrying out paper labelling or silk screen printing, which do not require the application of a significant amount of force to the container. Defects in shape of the container are compensated for by the flexibility of the applicator member for silk screen printing or labels fitted to the marking head.

Additionally, it is a known practice to equip the machine with fixed support rollers against which the container is supported during its marking. These support rollers are positioned opposite to the marking head relative to the container and provide a means of countering the marking force applied to the container. In particular, in the context of marking via a hot stamping process or by the application of a label that is thick and/or of metal, the marking force is higher than for a paper labelling or a silk screen printing process. Without the support rollers, the overhang span between the means for supporting the ends might be too large. When the container is made of plastic with thin walls, such as a conventional plastic bottle, due to its flexibility and relatively low degree of manufacturing defects, it is positioned satisfactorily between the support rollers and the marking member.

However, when the container is made of glass, metal or plastic material and has relatively thick walls, it has greater rigidity and more significant shape defects than a plastic container with thin walls. In this case, the support means and fixed support rollers are not suitable.

BRIEF SUMMARY

One aspect of the present invention is to provide an improved machine and method for marking an article, in particular by hot stamp marking, for example on a container made of glass, metal or plastic and having thick walls.

To this end, the invention relates to a machine for marking articles, this machine comprising at least:

a marking head configured to apply a marking force on an article along a first axis, a positioning system for positioning the article facing the marking head, wherein the article is positioned generally along a second axis perpendicular to the first axis, the positioning system comprising at least one carriage turret for holding the article, and a support system for supporting the article during its marking by the marking head, the support system comprising at least two rollers which bear the article during the application of the marking force on the article.

The machine is characterized in that when the article is positioned facing the marking head by at least one carriage turret, this carriage turret has a degree of freedom along a direction which is parallel to the first axis, and in that the support system and/or the at least one carriage turret includes backlash means along a direction parallel to a third axis, which is perpendicular to the first axis and the second axis to compensate for the shape defects of the article during application of the marking force.

Thus, the invention enables the improvement of the positioning of the article during its marking, and thereby the improvement of the quality of this marking. According to the invention, the support system and the carriage turret/s of the positioning system make it possible to define the reference position of the article in view of its marking and then, thanks to their being independently movable, to adapt to its shape defects during marking. If during this marking, the machine included one or more carriage turret or turrets fixed along the axis of marking, as well as supporting rollers fixed relative to each other, the support rollers would not be in contact at all times with the article and could not counter the marking force satisfactorily. The machine according to the invention is particularly suitable for hot stamping of articles, in particular of glass containers.

Preferably, the machine also includes a system for dispensing the marking tape between the marking head and the article. Alternatively, the machine may include a system for dispensing labels, in particular labels that are thick and/or made of metal, between the marking head and the article. In this case, the machine is a machine for marking articles by labelling.

According to other advantageous characteristic features of the machine according to the invention, taken individually or in combination:

Only the support system includes backlash means along a direction parallel to a third axis, these backlash means allowing a linear movement of the support rollers in this direction.

The positioning system comprises at least one pair of carriage turrets for supporting the article and when the article is positioned facing the marking head by the pair of carriage turrets, each carriage turret of this pair has a degree of freedom independent of the other carriage turret along the direction parallel to the first axis.

The positioning system comprises at least one pair of carriage turrets supporting the article and one of the two carriage turrets has a degree of freedom in a direction parallel to the second axis, offsetting the length defects of the article supported by the pair of carriage turrets.

The marking head comprises at least one marking member including an resiliently deformable outer part capable of offsetting the shape defects of the article along the first axis, while the rollers of the support system each include an outer peripheral part having a hardness lower than that of the article and higher than that of the outer part of the marking member.

The positioning system comprises at least two marking stations each comprising at least one carriage turret, each marking station receives an article to be marked independently of the other marking station or stations, and the support system equipping the machine is a single unique system shared by the different marking stations.

The positioning system comprises at least two marking stations each comprising at least one carriage turret, each marking station receives an article to be marked independently of the other marking station or stations, and each marking station is associated with a support system specific to it and which is movable with that marking station relative to the marking head.

The support system has a degree of freedom along a direction parallel to the second axis.

The support system comprises at least two pairs of rollers and, for each pair of rollers, the backlash means allows movement independent of the other pair or pairs of rollers in a direction parallel to the third axis.

The invention also relates to a method for marking articles, under the action of a marking head configured to apply a marking force on an article along a first axis, the method comprising the following successive steps:

a) a step of loading of an article in a positioning system comprising at least one carriage turret;

b) a step of positioning the article in front of the marking head via the positioning system, the article being positioned generally along a second axis perpendicular to the first axis and interposed between the marking head and a support system comprising at least two rollers adapted to receive the article bearing on it during its marking c) a step of marking consisting in applying the marking force along the first axis on the article via the marking head, and d) a step of unloading of the marked article out of the positioning system.

The process includes:

in that during the positioning step b) and marking step c), when the article is positioned facing the marking head by the at least one carriage turret, this carriage turret has a degree of freedom along a direction which is parallel to the first axis; and in that during the marking step c), the shape and form defects of the article are compensated by backlash means along a direction parallel to a third axis, which is perpendicular to the first axis and the second axis, these backlash means equipping the support system and/or the at least one carriage turret.

BRIEF DESCRIPTION OF THE DRAWINGS

The invention will be better understood upon reading the description which follows, given by way of non-limiting example and with reference made to the accompanying drawings in which:

FIGS. 1 to 6 show a machine 1, according to an embodiment of the invention, for marking articles.

DETAILED DESCRIPTION

Figure 1:
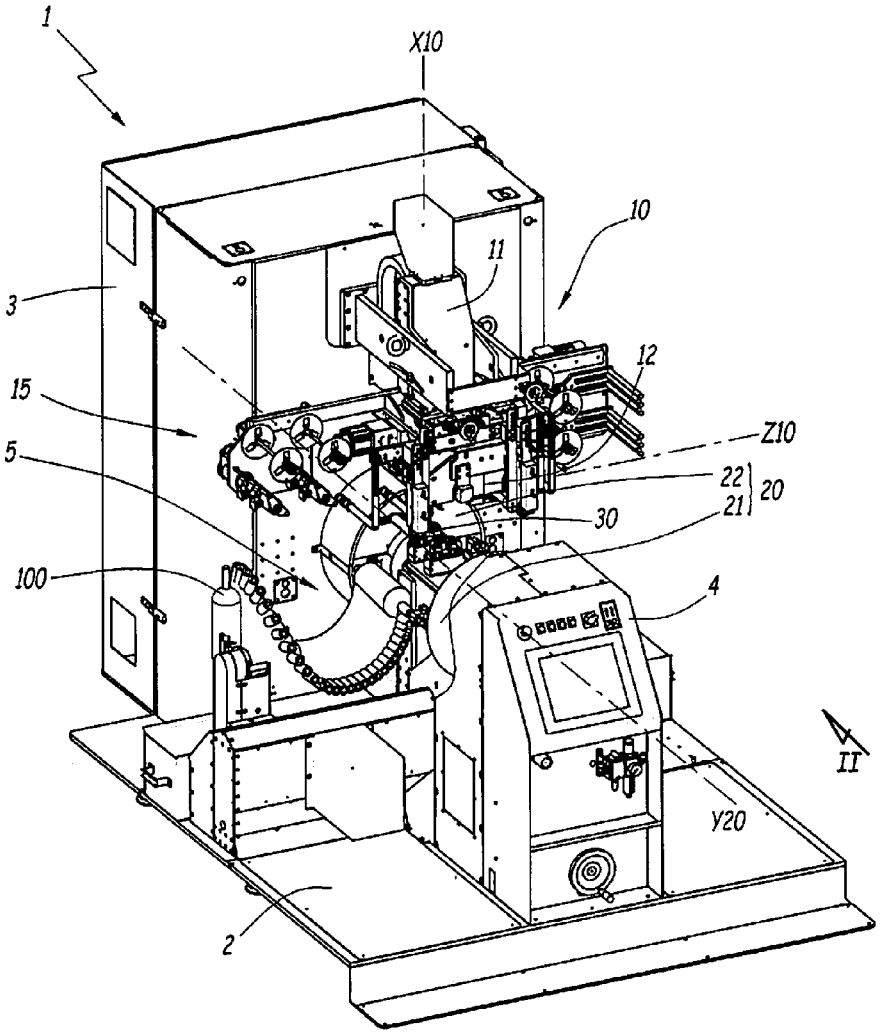
FIG. 1 is a perspective view of a marking machine according to an embodiment of the invention.

The machine 1 is intended to be used for decorating articles 100 by way of applying a marking on the external surface. In particular, the machine 1 is suitable for the hot stamp marking of containers 100.

The machine 1 comprises a base 2 for ground anchoring, an electrical cabinet 3, a control station 4, a system 5 for feeding the machine 1 with containers 100, a marking head 10, a system 20 for transporting and positioning of containers 100 so as to face the marking head 10, from the feeding system 5, as well as a system 30 for supporting the container 100 during the marking process. The housing for the electrical cabinet 3 and the housing for the control station 4 are fixed at the base 2. The machine 1 also comprises a system for unloading the marked containers 100, this system is not shown for the sake of simplification.

In the example in FIGS. 1 to 6, the containers 100 are glass bottles of a generally cylindrical shape. The containers 100 extend along a central axis A100 between a neck 101 and a rear end 102, or bottom, opposite to the neck 101. The containers 100 have a hollow body 103 of a generally cylindrical shape, whose external surface is intended to receive the marking. The body 103 has a circular cross section, centered on the central axis A100 of revolution of the container 100.

In practical terms, glass is an amorphous material that is geometrically imperfect. The production of containers 100 out of glass induces defects in shape that are specific to each of them, in other words, that may be variable from one container to another, whether in the same batch of containers or from batch to batch. These deformities may be, in particular, defects with respect to concentricity, cylindricity, and axial or radial backlash of the container 100. For example, the lack of eccentricity of the neck 101 with respect to the body 103 may be of the order of two millimeters. According to another example, the diameter of the body 103 may vary by plus or minus one millimeter along the axis A100. In another example, the length of the container 100 between the neck 101 and the end 102 may vary by plus or minus two millimeter along the axis A100.

Alternatively, the container 100 may be fabricated from another rigid material also liable to exhibit geometrical imperfections. For example, the container 100 may be made of metal, of various types such as aerosol, fire extinguisher body, metal bottle, etc. According to another example, the container may be made of plastic with thick walls, obtained by molding or blow molding processes, of the types including bottles, jars or pots, or even by overmolding, in particular of plastic material on plastics, on glass or on metal.

The present invention is applicable to all rigid articles likely to have geometrical imperfections, and particularly irregular external forms. Such articles may be handled by being held by a pair of means for supporting the ends, in particular between center positions as in the example in FIGS.

1 to 6, or by a means for supporting a single end, whether or not by being held between centers during the marking.

According to the invention, the machine 1 is capable of compensating for the defects in shape and form specific to each article 100 during its marking.

Figure 2:
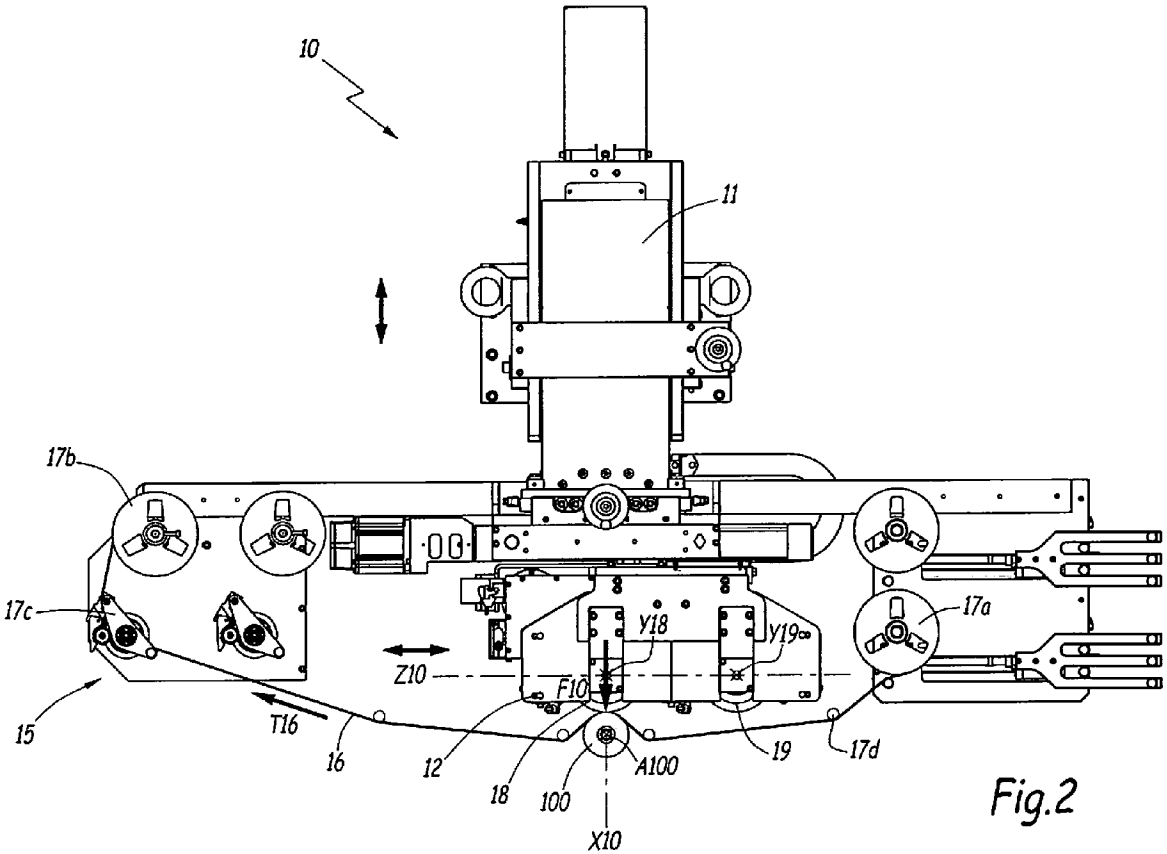
FIG. 2 is a partial view of the machine along the direction of arrow II in FIG. 1, on an enlarged scale, showing a marking head.

As shown in FIGS. 1 and 2, the marking head 10 includes a carriage 11 movable relative to the housing for the electrical cabinet 3 along a vertical marking axis X10, a carriage 12 movable relative to the carriage 11 along a horizontal axis Z10, a system 15 for dispensing marking tape 16, as well as two marking rollers 18 and 19 mounted so as to pivot on the carriage 12. The marking head 10 is configured to apply a marking force F10 on a container 100 along the axis X10. For the intended applications, this marking force F10 may be very significant, for example in the order of 12,000 Newtons. Under these conditions, the support system 30 is used to define a reference position for the container 100 along the axis X10 and counter the marking force F10, as detailed here below.

Figure 3:
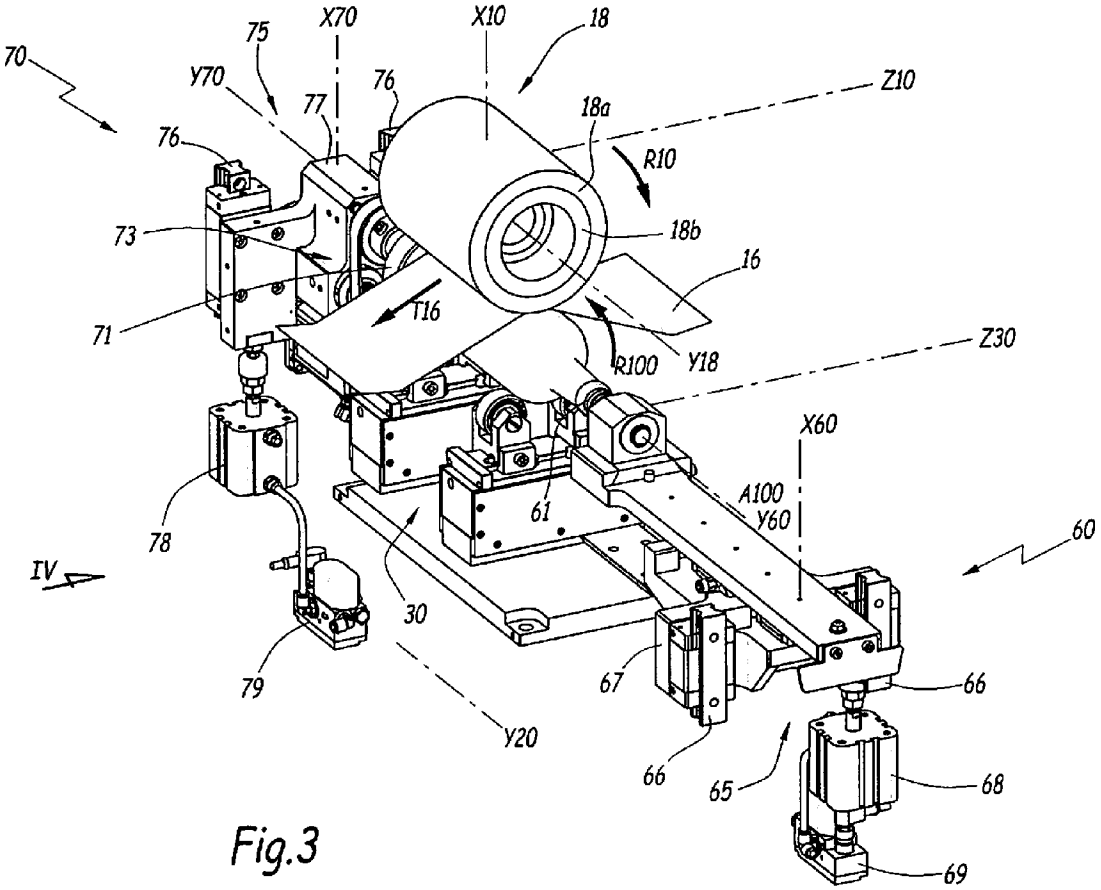
FIG. 3 is a partial view in perspective of the machine in FIG. 1, on an enlarged scale, showing a marking station for marking an article.
Figure 6:
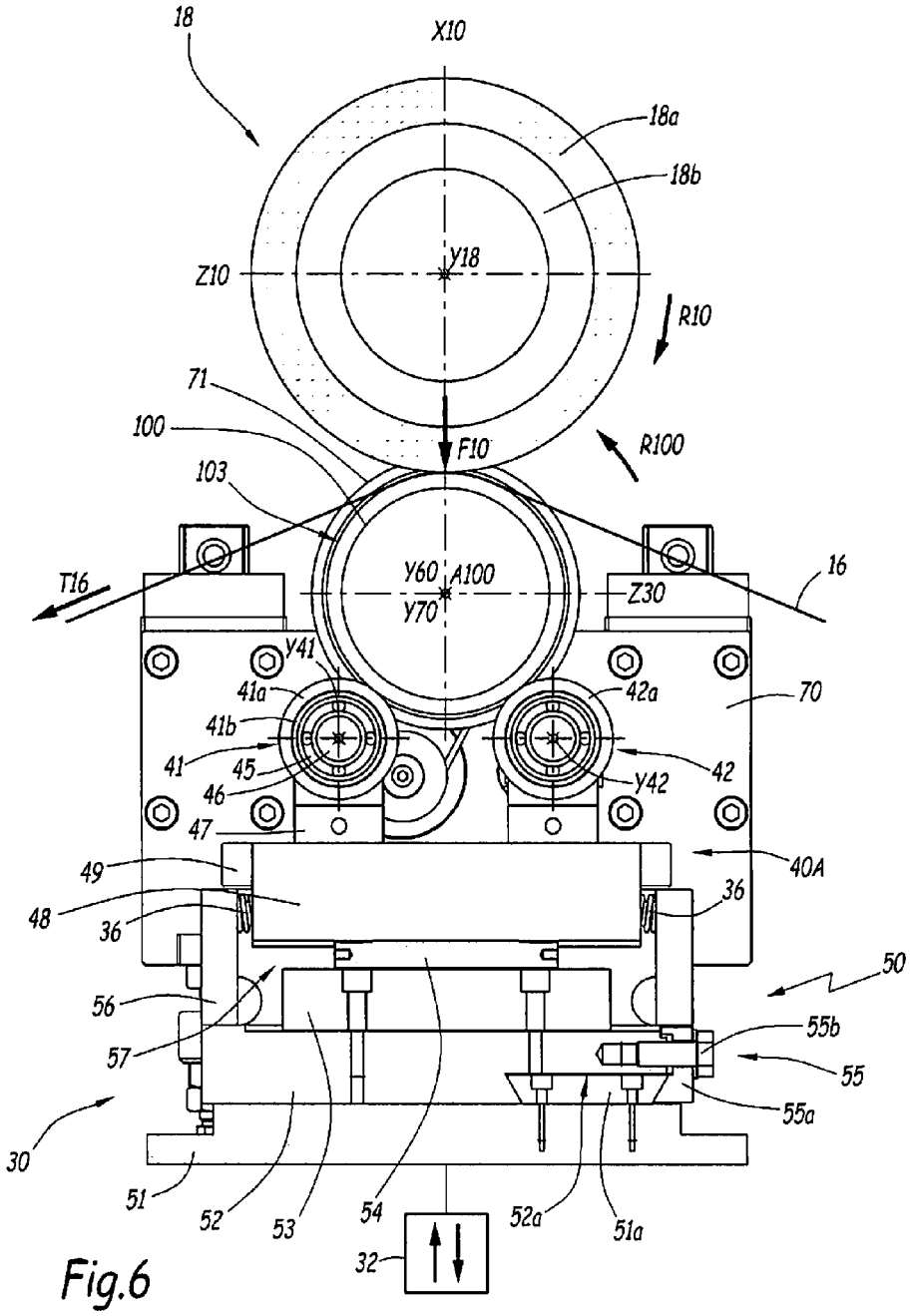
FIG. 6 is a cross section along the line VI-VI in FIG. 5.

As shown in FIGS. 3 and 6, the roller 18 includes a peripheral part 18*a* made of silicone, resiliently deformable during the marking of the container 100 as well as a rigid inner part 18*b*, for example made of metal. The silicone part 18*a* has a greater thickness and a lower surface hardness than if the roller 18 had been designed for labelling plastic containers. Arranged in the carriage 12 there is a device for heating the roller 18 with a view to carrying out the hot stamp marking, for example, heating tiles. The roller 18 is rotatable relative to the carriage 12 about an axis Y18, perpendicular to the axis Z10. During application of the marking force F10 by the roller 18 on the container 100, the axis Y18 is perpendicular to the axis X10. The diameter of the roller 18 is preferably greater than or equal to the diameter of the body 103 of the container 100. The roller 18 is equipped with a drive motor with digital control arranged in the carriage 12. During marking, this motor causes the roller 18 to pivot about the axis Y18 following a rotational movement R10, shown by an arrow in FIGS. 3 and 6, in the direction opposite to that of the container 100 but with the same linear velocity at their interface. The description given here above with reference to the roller 18 is applicable to the roller 19 which is rotatable relative to the carriage 12 about an axis Y19.

Advantageously, the carriage 12 or at least a portion of the carriage 12 including the rollers 18 and 19 is removable so as to enable the modification in a simple manner of the configuration of the marking head 10. According to a particular alternative, the marking head 10 may comprise a single marking roller, which preferably has a diameter twice that of the rollers 18 and 19.

The dispensing system 15 is configured so as to run the marking tape 16 between the container 100 and the rollers 18 and 19 in the direction schematically represented by an arrow T16 in FIGS. 2, 3 and 6. In the simplest case, the system 15 includes a single tape 16, which is shown in FIGS. 2 to 6 and not shown in FIG. 1. The rollers 18 and 19 press-flatten this tape 16 in alternating fashion on successive containers 100. Thus, the rollers 18 and 19 have more time to get heated up before carrying out another marking operation. Alternatively, the dispensing system 15 shown in FIGS. 1 and 2 can be configured so as to run two tapes 16 in parallel, each one between the container 100 and one of the rollers 18 and 19. In this case, the rollers 18 and 19 are narrower and offset relative to each other in the direction defined by their axes Y18 and Y19. Within the system 15, the or each tape 16 travels from a supply reel 17*a* to a collecting reel 17*b*, under the action of a pulling device 17*c*. Return rollers 17*d* schematically represented for the purpose of simplification, are used to define the path of travel of the tape 16 between the reels 17*a* and 17*b*, the rollers 18 and 19 and the container 100. The running of the tape 16 is synchronized with the movement of the rollers 18 and 19.

Figure 4:
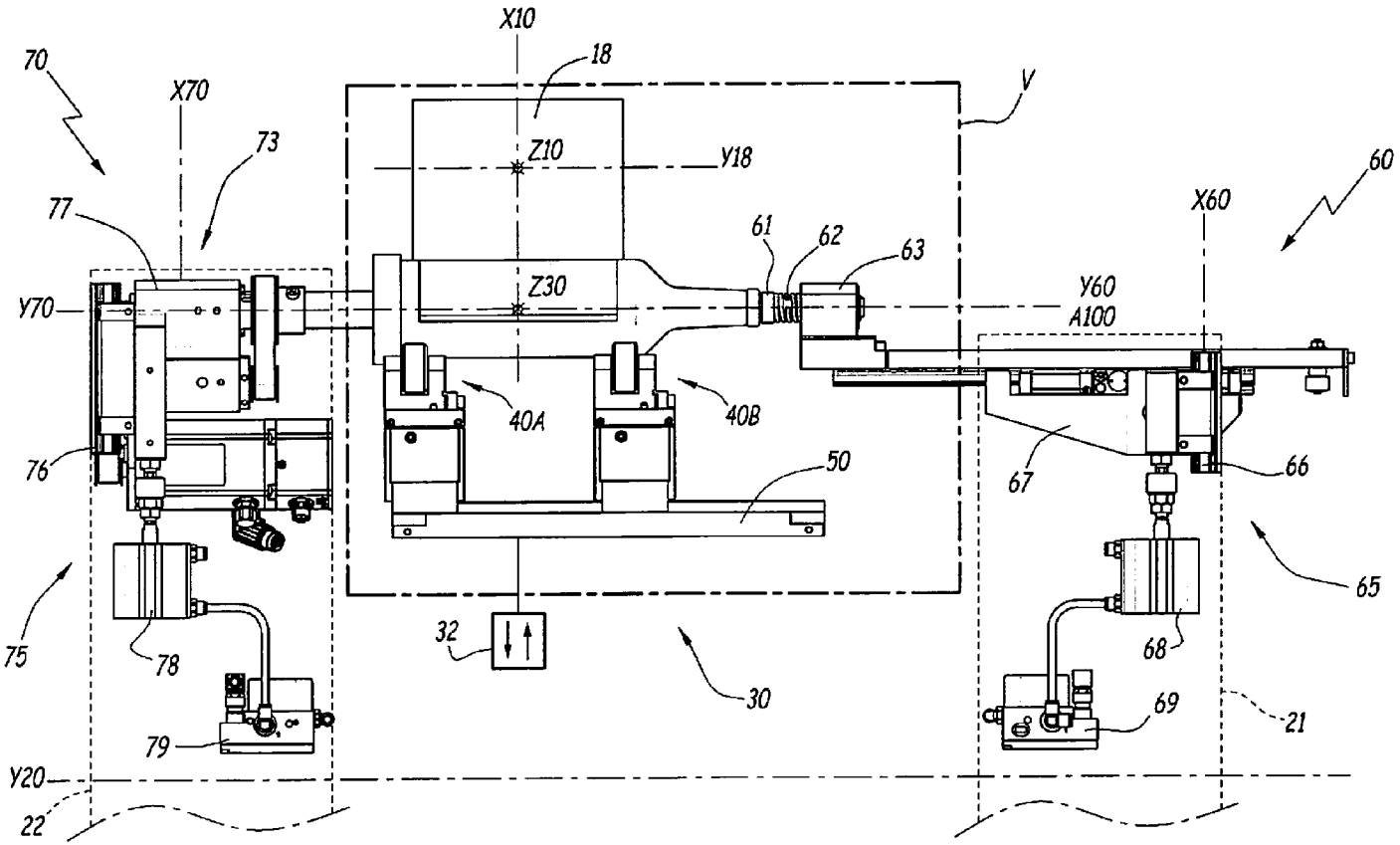
FIG. 4 is a view along the arrow IV in FIG. 3
Figure 5:
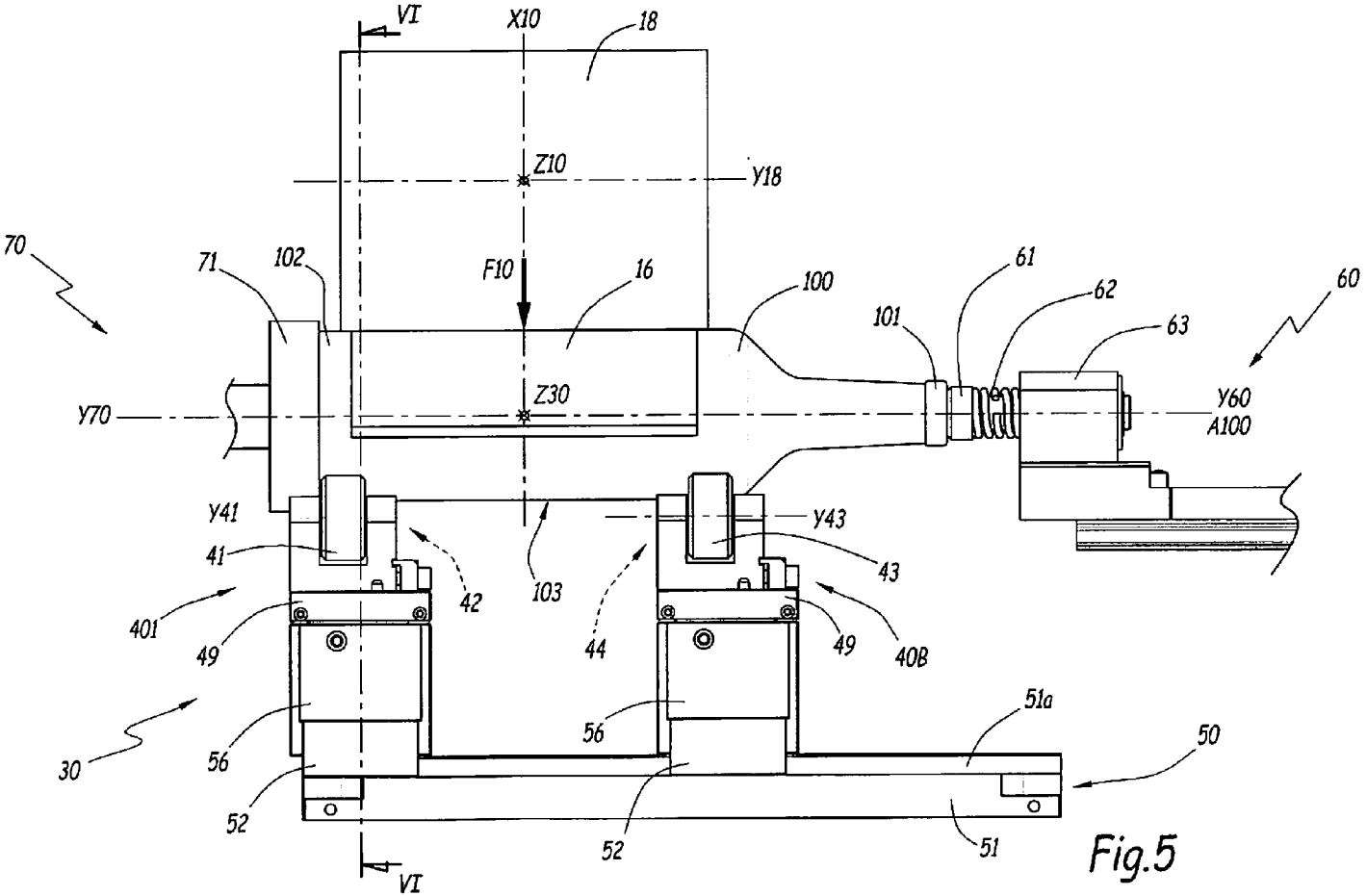
FIG. 5 is a view on an enlarged of the detail V in FIG. 4.

As shown in FIGS. 1 and 4, the system 20 of transporting and positioning of containers 100 includes a front platen 21 mounted so as to be movable relative to the housing of the control station 4 and a rear platen 22 mounted so as to be movable relative to the housing of the electrical cabinet 3. The housing of the control station 4 is shown partially torn in FIG. 1 in order to better show the platen 21. In addition, the platens 21 and 22 are shown in dashed lines in FIG. 4 for the purpose of simplification. In practice, the platens 21 and 22 are rotatable about a horizontal axis of rotation Y20, in a synchronized manner with each other by means of mechanical or digital connection. This synchronized rotation may be alternating or continuous depending on the application and the configuration of the machine 1. The axis Y20 is perpendicular to the axis X10 and parallel to the axis Y18. The support system 30 is disposed between the platens 21 and 22 along the front-rear direction, defined in a parallel manner to the axis Y20. When the platens 21 and 22 pivot about the axis Y20, the support system 30 does not pivot.

According to the embodiment in FIGS. 1 to 6, the machine 1 comprises four distinct transport and marking stations. In other words, the positioning system 20 includes potential transport means for four containers 100. In practice, the four stations of the positioning system 20 may have up to three containers 100 simultaneously: one container 100 received from the feeding system 5 before prior to marking, one container 100 in process of being marked by the marking head 10 and one container 100 already marked being sent to the unloading system. The last station, close to the base 2 during the rotation of the platens 21 and 22 around the axis Y20 does not transport any containers 100.

The front platen 21 includes four front carriage turrets 60, while the rear platen 22 includes four rear carriage turrets 70. Except for the synchronized rotation around the axis Y20, the component members of the positioning system 20 are independently movable radially to axis Y20, as detailed here below. On the platen 21, the carriage turrets 60 are mutually independent of each other and independent of the carriage turrets 70. On the platen 22, the carriage turrets 70 are mutually independent of each other and independent of the carriage turrets 60. Each carriage turret 60 includes means for moving radially to the axis Y20. Similarly, each carriage turret 70 includes means for moving radially to the axis Y20. In other words, each independent carriage turret 60 and 70 has a degree of freedom along a direction perpendicular to the axis Y20. More specifically, when the marking station, including carriage turrets 60 and 70 is positioned facing the marking head 10, each independent carriage turret 60 and 70 has a degree of freedom along a direction defined by an axis, respectively X60 and X70, parallel to the axis X10 and the marking force F10. Within each marking station formed by a pair of carriage turrets 60 and 70, they are preferably mechanically independent without any mechanical member connected between them. Apart from the synchronized rotation of the platens 21 and 22 around the axis Y20, carriage turrets 60 and 70 are independently movable radially, and their movements may be selectively synchronized if necessary.

Alternatively, the carriage turrets 60 and 70 can be connected by a mechanical member. In this case, each carriage turret 60 and 70 has a degree of freedom along the direction defined by the axes X60 and X70, in a manner that is interdependent on each other.

The carriage turret 60 is provided with a tailstock 61 adapted to be lodged in the neck 101 formed at the front end of the container 100, while the carriage turret 70 is provided with a catch bottom 71 for the rear end 102 of the container 100. The tailstock 61 has a profile elongated along an axis Y60 parallel to the axis Y20. The tailstock 61 is configured so as to penetrate into the neck 101, even when there is angular movement between the axes Y60 and A100. The bottom 71 has a hollow tubular profile centered on an axis Y70 parallel to the axis Y20. The bottom 71 is configured so as to engage around the end 102, even when there is angular movement between the axes Y70 and A100. Thus, the container 100 may be maintained between its two ends 101 and 102 by the tailstock 61 and the bottom 71, which form the means for supporting the ends of the container 100 during its transport, its positioning and marking. The axes Y60 and Y70 are always parallel to the axis Y20 and to each other, while the orientation of the axis A100 depends on the defects in shape and form of the container 100 and on a possible spacing between the axes Y60 and Y70. In the ideal case shown in FIGS. 1 to 6 the axes Y60, Y70 and A100 are aligned. When the marking station comprising the carriage turrets 60 and 70 is positioned opposite the marking head 10, the axis Y60 is perpendicular to the axis X60 and the axis Y70 is perpendicular to the axis X70.

The carriage turret 60 is also provided with a spring 62 disposed between the tailstock 61 and a base 63 for supporting this tailstock 61. In practice, the tailstock 61 is mounted so as to be slidable along the axis Y60 in this support base 63. The spring 62 tends to push the tailstock 61 in the direction of the bottom 71. Thanks to the spring 62, the shape defects and deformities of the container 100 in length along its axis A100 can be compensated. The spring 62 shown is a mechanical one, however alternatively the carriage turret 60 can be provided with a pneumatic spring. Thus, the carriage turret 60 has a degree of freedom along the front-rear direction parallel to the axis Y60, in a manner so as to compensate for defects in length of the container 100 along the axis A100. For example, this compensation may be in the range of plus or minus two millimeters. The reference position of the container 100 along the front-rear direction is thus defined by the bottom 71 of the carriage turret 70.

The carriage turret 60 further comprises a radial linear guide device 65, comprising of two rails 66 integrally fixed to the platen 21 pivoting about the axis Y20, a block 67 movable radially to the axis Y20 by sliding on the rails 66, a pneumatic cylinder 68 and a pressure regulator 69. The device 65 is actuated by the pneumatic cylinder 68, designed to move the block 67 along the rails 66. The base 63 for supporting the tailstock 61 is integrally fixed to the block 67. Thus, the device 65 makes it possible to move the tailstock 61 radially to the axis Y20, that is to say along the axis X60 parallel to the axis X10 when the carriage turret 60 and the container 100 are positioned facing the marking head 10.

The carriage turret 70 comprises a geared motor unit 73 for driving the rotation of the bottom 71 about the axis Y70. More precisely, the device 73 is configured so as to pivot the container 100 that is engaged with the bottom 71 along a rotational movement R100, represented by an arrow in FIGS. 3 and 6, about the axis Y70 during the application of the marking force F10. The direction of rotation R100 of the bottom 71 and of the container 100 is opposite to the direction of rotation R10 of the marking roller 18. The rotations R10 and R100 are synchronized with the same linear velocity at their contact interface.

The turret carriage 70 further comprises a radial linear guide device 75, comprising of two rails 76 integrally fixed to the platen 21 pivoting about the axis Y20, a block 77 movable radially to the axis Y20 by sliding on the rails 76, a pneumatic cylinder 78 and a pressure regulator 79. The device 75 is actuated by the pneumatic cylinder 78, designed to move the block 77 along the rails 76. The geared motor unit 73 is integrally fixed to the block 77, while the bottom 71 is mounted so as to pivot about the axis Y70 relative to this block 77. Thus, the device 75 enables movement of the bottom 71 radially to the axis Y20, that is to say along the axis X70 parallel to the axis X10 when the turret carriage 70 and the container 100 are positioned facing the marking head 10. The device 75 of the carriage turret 70 is independent of the device 65 of the carriage turret 60.

When the container 100 is not positioned in front of the marking head 10, in particular when it is being loaded in the positioning system 20, the pneumatic cylinder 68 and 78 maintain the devices 65 and 75 in stop position internally or externally, which constitutes the reference position of the positioning system 20 radially to the axis Y20. In this reference position, the axes Y60 and Y70 respectively defined by the tailstock 61 and the bottom 71 are as close as possible to the axis Y20. Once the carriage turrets 60 and 70 have brought the container 100 to its position in front of the marking head 10, the support system 30 comes to bear against the container 100, as detailed here below.

As shown in FIGS. 3 to 6, the support system 30 comprises a vertical linear movement device 32, the blocks 40A and 40B supporting four support rollers 41, 42, 43 and 44 arranged in pairs, as well as a support base 50 interposed between the device 32 on the one hand and the blocks 40A and 40B on the other hand. The four rollers 41, 42, 43 and 44 are capable of supporting the container 100 bearing thereon, before and during the application of the marking force F10. The device 32 is schematically represented only in FIGS. 4 and 6, in the interest of simplification.

The device 32 comprises a digital control motor and means for transmitting movement to the base 50. The device 32 is designed to move the base 50 along the vertical direction defined by the axis X10, in particular by bringing it closer to the marking head 10 when the container 100 supported by the carriage turrets 60 and 70 is positioned opposite the marking head 10. In practice, the base 50, the blocks 40A and 40B and the rollers 41-44 are moved by the device 32 by a predetermined distance, for example of the order of five millimeters in the direction of the marking head 10. The container 100 comes to bear on the rollers 41-44 and is moved in the direction of the marking head 10, thanks to the degree of freedom of the carriages turrets 60 and 70 along the axes X60 and X70 parallel to the axis X10. After this movement, the support system 30 defines a reference position for the container 100 along the axis X10, prior to the application of the marking force F10. More specifically, the reference position is defined by the rollers 41-44. Preferably, during the marking, the device 32 exerts on the base 50 a force opposite to the force F10, so as to maintain the reference position defined by the rollers 41-44.

As shown in FIG. 6, the roller 41 includes an outer peripheral part 41*a* made of polyurethane, resiliently deformable during the marking of the container 100 as well as a rigid inner part 41*b*, for example made of metal. The outer part 41*a* has a hardness lower than that of the container 100 and greater than that of the outer part 18*a* of the marking rollers 18 and 19. Thus, the outer part 41*a* does not cause any damage to the container 100 and any eventual decorative embellishments or prior varnishing while ensuring the reference position. Mounted in the inner part 41*b* is a ball bearing 45, which itself is mounted on a shaft 46 integrally fixed to a support piece 47. Thus, the roller 41 is rotatable relative to the support piece 47 around a horizontal axis Y41. The description provided above with reference made to the roller 41 also applies to roller 42, which includes in particular an outer peripheral part 42*a* made of polyurethane. The two support pieces 47 are mounted on a platen 48, in part, positioned in a housing 57 of the base 50, as detailed here below. The roller 42 is rotatable, relative to its own support piece, about a horizontal axis Y42 parallel to the axis Y41. The center to center spacing between the rollers 41 and 42 is constant during the marking. This spacing can be adjusted when the machine 1 is not in operation, in particular so as to accommodate the particular dimensions of a new batch of containers 100 to be marked. Two bars 49 are fixed to the sides of the platen 48, on each side of the rollers 41 and 42. The bars 49 cover the top opening of the housing 57, on both sides of the platen 48, so as to prevent dust or foreign objects from getting inside the housing 57.

The description provided herein with reference made to the block 40A including the rollers 41 and 42 also applies to block 40B including the rollers 43 and 44. The roller 43 is rotatable relative to its support piece 47 about a horizontal axis Y43. The roller 44 is rotatable relative to its own support piece 47 about a horizontal axis parallel to the axis Y43. The center to center spacing between the rollers 43 and 44 is constant during the marking and adjustable when the machine 1 is not in operation. In other words, each block 40A and 40B includes a pair of rollers, respectively 41-42 and 43-44, a pair of bearings 45, shafts 46 and support pieces 47, as well as a single platen 48 flanked by two lateral bars 49.

The base 50 comprises a stack of platens 51 and 52, a rail 53 and a recirculating ball bearing guide 54. The platen 51 is a single, while the elements 52, 53 and 54 are arranged in each block 40A and 40B. The ball bearings of the recirculating guide 54 are not shown in the cross sectional plane in FIG. 6. The base 50 also includes, for each block 40A and 40B, a device 55 for securing the platens 51 and 52 with each other, two lateral walls 56 defining the housing 57. The lower platen 51 is connected to the device 32. The platen 51 is secured to a pin 51*a* of trapezoidal shape, while the rail 53 is secured to platen 52 by means of screws not shown in their screw holes for the purpose of simplification. The pin 51*a* is positioned in a recess 52*a* of a trapezoidal shape formed in the platen 52 disposed on the platen 51. The platen 52 can slide over the platen 51, and then the device 55 serves to lock their respective positions. For this purpose, the device 55 includes a piece 55*a* which can be pressed flat against the pin 51*a* by screwing a screw 55*b* in the platen 52. The pin 51*a*, the recess 52*a* and the device 55 can thus form a mechanical connection of the dovetail type. The platen 48 of each block 40A and 40B is partially housed in the housing 57, between the walls 56. The platen 48 rests on the recirculating ball bearing guide 54, forming a sliding connection between the base 50 and the block 40A or 40B.

As shown in FIG. 6, the support system 30 also includes springs 36 interposed between the base 50 and each block 40A and 40B. More specifically, for each block 40A and 40B, two springs 36 are disposed on each side of the platen 48 between this platen 48 and the walls 56. The springs 36 are compressible/extensible along a direction defined by a horizontal axis Z30 perpendicular to the axes X10 and Z70. The springs 36 shown are mechanical, however, an alternative support system can be equipped with pneumatic springs. The springs 36 constitute the backlash means for the support system 30 along the horizontal direction defined by the axis Z30. In other words, these springs 36 constitute backlash means for each block 40A or 40B, and thus for each pair of rollers 41-42 or 43-44, along this horizontal direction defined by the axis Z30, perpendicular to their respective axes Y41 and Y43. The sliding connection defined between each platen 48 and 54 permits and facilitates this backlash along the axis Z30. In other words, the platens 48 and 54 form linear guide means for each block 40A and 40B relative to the base 50. When the container 100 comes to bear against the rollers 41-44, the springs 36 and the linear guide means 48+54 allow each pair of support rollers 41-42 and 43-44 to move in linear direction parallel to the axis Z30, independently of the other pair of rollers. Thus, the rollers 41-44 remain in contact with the container 100 despite its shape defects and deformities, prior to marking and during its marking, in particular during its rotation around the axis Y70.

Moreover, the support system 30 may have an additional degree of freedom along the front-rear direction defined parallel to the axes Y20, Y60 and Y70. In this case, each block 40A and 40B or at least one of them is also movable relative to the base 50 along this front-rear direction. For this purpose, additional backlash means, for example of the spring type are disposed between the base 50 and the block 40A and/or 40B. In other words, the backlash for the rollers 41-44 is thus possible along two horizontal directions perpendicular to the vertical direction defined by the marking axis X10.

The marking method according to the invention is detailed here below.

Firstly, the method comprises a step a) of loading a container 100 in the positioning system 20, via the feeding system 5. The positioning system 20 includes at least one carriage turret 60 and/or 70, preferably at least one pair of carriage turrets 60 and 70. The first carriage turret 60 is provided with a tailstock 61 being lodged in the neck 101 of the container 100, while the second carriage turret 70 is provided with a catch bottom 71 for holding the container 100 opposite the neck 101.

The method also includes a step b) of positioning the container 100 in front of the marking head 10 via the positioning system 20. At this stage, the container 100 is positioned generally along the axis Y70 defined by the bottom 71, perpendicular to the axis X10. The container 100 is interposed between the marking head 10 and the support system 30 comprising at least two rollers 41-44, which are adapted to receive the container 100 bearing on it during its marking. When the container 100 is positioned facing the marking head 10 by at least one carriage turret 60 and/or 70, this or each carriage turret has a degree of freedom along a direction parallel to the axis X10. These directions are respectively defined by the axes X60 and X70.

The method then comprises a step c) of marking consisting in applying the marking force F10 along the axis X10 on the container 100 via the marking head 10 and, at the same time, compensating for the defects in shape of the container 100 via the means 36 of backlash in a direction parallel to the axis Z30. A tape or label 16 is interposed between the marking head 10 and the container 100. The marking force F10 is applied by one of the rollers 18 or 19 made of silicone, whose flexibility allows it to absorb a part of the defects in shape of the container 100 and the marking force F10, without changing the position of the container 100. The axis of backlash Z30 is perpendicular to the axes X10 and Y70. In practice, the backlash means 36 are provided to the support system 30 and/or the at least one carriage turret 60 and/or 70. In the case where backlash means 36 are provided to the support system 30, they permit a linear displacement of the support rollers 41-44 along the direction parallel to the axis Z30. In the case where the backlash means 36 are provided to at least one of the carriage turrets 60 and 70, they permit a linear displacement of the tailstock 61 and/or of the bottom 71 along the direction parallel to the axis Z30.

The method comprises finally a step d) of unloading of the marked container 100 out of positioning system 20, then out of the machine 1.

Moreover, the machine 1 may be shaped differently from the FIGS. 1 to 6 without departing from the scope of the invention. In particular, the marking head 10, the positioning system 20 and the support system 30 may be shaped differently.

By way of a variant not shown, each transport station belonging to the positioning system 20 may comprise a single carriage turret 100 for transporting an article 100. In this case, during the marking, the container 100 can be supported by this single carriage turret, or even be held by an additional carriage turret. In other words, each transport and marking station may comprise a means for supporting a single end of the container 100, or indeed a pair of means for supporting the ends of the container 100.

According to another variant not shown, the machine 1 may include a single marking station. In this case, the positioning system 20 includes a single carriage turret 60 and/or 70 or a single pair of carriage turrets 60 and 70. The platen 21 includes a single carriage turret 60 and/or the platen 22 includes a single carriage turret 70.

Preferably, the machine 1 comprises at least two marking stations with at least two pairs of carriage turrets 60 and 70. In this case, each pair of carriage turrets 60 and 70 constitutes a marking station for a container 100 independently of the other pairs of carriage turrets. In the example in FIGS. 1 to 6, the support system 30 is a single one and shared by the different marking stations. Alternatively, each marking station may be associated with a support system 30 specific to it. Each support system 30 is thus equipped with its marking station and movable with this marking station relative to the marking head 10.

According to another variant not shown, the carriage turrets 60 and 70 of each pair or of at least some pairs may be connected by one or more mechanical members, for example a bar. In other words, the rotation of the carriage turrets 60 and 70 around the axis Y20 is synchronized by mechanical connection. In this case also, when the container 100 is positioned facing the marking head 10 by the pair of carriage turrets 60 and 70, each carriage turret 60 and 70 of this pair has a degree of freedom in a direction parallel to the axis X10.

According to another variant not shown, the front carriage turret 60 can be provided with a bottom 71 and with a device for driving the rotation of the bottom 71, while the rear carriage turret 70 is provided with a tailstock 61 and with a damping device. Preferably one of the carriage turrets 60 and 70 has a degree of freedom along the front-rear direction, in a manner so as to compensate for the defects in the length of the container 100.

According to another variant not shown, the means for supporting the ends of container 100 may be configured differently with a tailstock 61 and a bottom 71.

According to another variant not shown, in replacement of the system 15 for dispensing of tape 16, the machine 1 according to the invention can be equipped with a system for dispensing label to be affixed to the container 100 under the action of the marking head 10.

According to another variant not shown, the support system 30 may comprise a single movable block 40A supported by the base 50, as well as with backlash means 36 interposed between the block 40A and the base 50. The movable block 40A may include one or more pairs of rollers fixed to each other and movable relative to the base 50 thanks to the backlash means 36.

According to another variant not shown, the axis X10 of the marking head 10 may be positioned horizontally, while axis Y20 of the positioning system 20 is arranged vertically.

According to another variant not shown, the axis X10 of the marking head 10 and the axis Y20 of the positioning system 20 are both arranged vertically. For example, the positioning system 20 may be configured as a horizontal disk on which the axis A100 of the container 100 is oriented horizontally.

According to another variant not shown, the machine 1 may include a linear transport and positioning system instead of the pivoting transport and positioning system 20 shown in FIGS. 1 to 6. In this case, the carriage turrets 60 and 70 may be mounted on parallel rails and be movable linearly in a direction perpendicular to the axis X10 of the marking head 10. Each pair of carriage turrets 60 and 70 constitutes a marking station for a container 100 independently of other pairs of carriage turrets.

According to a variant, not shown, within the transport and positioning system 20, each of the pneumatic cylinders 68 and 78 may be replaced by a pair of opposing springs, according to an arrangement similar to that of the springs 36 in the support system. This variant is particularly applicable to a machine with transport of containers in a horizontal plane, in a linear manner or on a platen with vertical axis.

According to another variant not shown, the system 20 does not permit the transport of containers 100 from one zone of the machine 1 to another, but only the positioning of the containers 100 in front of the marking head 10, with the help of a carriage turret 60 and/or 70 or a pair of carriage turrets 60 and 70. In this case, the containers may be positioned and unloaded manually from the positioning system 20 comprising at least one carriage turret 60 and/or 70.

According to another variant not shown, the machine 1 may be adapted for marking faceted articles, having a generally polygonal cross section. In this case, the marking head 10 may be equipped with a flat plate, suitable for marking a facet that is generally planar, rather than a cylindrical roller. The support system 30 and the bottom 71 are specifically adapted to receive the article with facets. For example, the system 30 may include a specific number of pairs of rollers 41-44 and/or 41-44 these rollers may have a specific arrangement, corresponding to the particular form of the faceted article. The positioning system 20 does not necessarily include means for driving the rotation of the bottom 71.

According to another variant not shown, the machine 1 may be adapted for the marking of articles of parallelepiped shape, having a generally square or rectangular cross section. The cylindrical roller 18 is made to roll on a planar surface of the article. The support system 30 and the bottom 71 are specifically adapted to receive this article. The positioning system 20 does not necessarily include means for driving the rotation of the bottom 71.

According to another variant not shown, the machine 1 may be adapted for marking articles with oval or conical cross section. The marking head 10 may be provided with a plate comprising a rigid metal base and a peripheral part made of silicone, which has a profile specially adapted to the particular shape of the article. The support system 30 and the bottom 71 are specifically adapted to receive this article.

According to another variant not shown, the positioning system 20 may comprise a carriage turret, in particular at least one of the independent carriage turrets 60 and 70 of the same pair, which is provided with horizontal backlash means. In this case, the support system 30 cannot be provided with horizontal backlash means.

Whatever be the embodiment, the support system 30 and/or the at least one carriage turret 60 and/or 70 includes backlash means along a direction parallel to the axis Z30, which is perpendicular to the axes X10 and Y70 in order to compensate for defects in shape and form of the article 100 during the application of the marking force F10.

Moreover, the technical characteristics of the various embodiments and variants proposed here above may, with respect to all or some of them, be combined. Thus, the machine 1 may be suitably adapted in terms of cost, functionality and performance.

The invention claimed is:

1. A machine for marking articles, the machine including at least:

a marking head configured to apply a marking force on an article along to a first axis;

a positioning system for positioning the article facing the marking head, wherein the article is positioned generally along a second axis oriented perpendicular to the first axis, the positioning system comprising at least one carriage-turret for holding the article; and a support system for supporting the article during marking of the article by the marking head, the support system comprising at least two rollers which bear the article during application of the marking force of the marking head on the article;

wherein the at least one carriage-turret has a degree of freedom along a direction that is parallel to the first axis when the article is positioned facing the marking head by the at least one carriage-turret; and wherein the support system includes backlash means along a direction parallel to a third axis, which is oriented perpendicular to the first axis and the second axis, to compensate for shape defects of the article during application of the marking force.

2. The marking machine according to claim 1, wherein the support system includes the backlash means along a direction that is parallel to the third axis, the backlash means allowing a translation of the rollers in the direction that is parallel to the third axis.

3. The marking machine according to claim 1, wherein the positioning system comprises at least one pair of carriage-turrets for supporting the article, each of the carriage-turrets of the at least one pair having a degree of freedom that is independent of the other carriage-turret in the pair in the direction parallel to the first axis when the article is positioned across from the marking head by the pair of carriage-turrets.

4. The marking machine according to claim 1, wherein the positioning system comprises at least one pair of carriage-turrets supporting the article, one of the carriage-turrets in the pair having a degree of freedom in a direction parallel to the second axis to offset length defects of the article supported by the pair of carriage-turrets.

5. The marking machine according to claim 1, wherein the marking head comprises at least one marking member including an elastically deformable outer part configured to offset the shape defects of the article along the first axis, wherein the rollers of the support system each include an outer peripheral part having a hardness that is less than the article and greater than the outer part of the marking member.

6. The marking machine according to claim 1, wherein the positioning system comprises at least two marking stations each comprising at least one carriage-turret, each of the marking stations receiving an article to be marked independently of the other ones of the marking stations, the support system equipping the machine being unique and shared by the different marking stations.

7. The marking machine according to claim 1, wherein the positioning system comprises at least two marking stations and at least two support systems, each of the marking stations comprising at least one carriage-turret, each of the marking stations receiving an article to be marked independently of the other ones of the marking stations, each of the marking stations being associated with one of the support systems specific to the respective marking station and which is movable with the marking station relative to the marking head.

8. The marking machine according to claim 1, wherein the support system has a degree of freedom in a direction parallel to the second axis.

9. The marking machine according to claim 1, wherein the support system comprises at least two pairs of rollers and, for each of the pairs of rollers independently of the other pairs of rollers, backlash means in a direction parallel to the third axis.

10. A method for marking articles, under the action of a marking head configured to apply a marking force on an article along a first axis, the method comprising:

loading the article in a positioning system comprising at least one carriage-turret;

positioning the article facing the marking head via the positioning system, the article being positioned generally along a second axis oriented perpendicular to the first axis and interposed between the marking head and a support system comprising at least two rollers adapted to bear the article during marking of the article;

marking the article by applying the marking force along the first axis on the article via the marking head; and discharging the article that is marked out of the positioning system;

wherein the at least one carriage-turret has a degree of freedom along a direction which is parallel to the first axis during positioning and marking when the article is positioned facing the marking head; and wherein shape defects of the article are compensated by backlash means along a direction parallel to a third axis during marking of the article, the third axis oriented perpendicular to the first axis and the second axis, the backlash means equipping the support system.

* * * * *